US011125464B2

(12) United States Patent
Joyner, Jr. et al.

(10) Patent No.: US 11,125,464 B2
(45) Date of Patent: Sep. 21, 2021

(54) METHOD AND SYSTEM FOR VENTED ROLLOUT SWITCH

(71) Applicant: Allied Air Enterprises Inc., West Columbia, SC (US)

(72) Inventors: George Lee Joyner, Jr., Florence, SC (US); Randall Moody, Aiken, SC (US); Jeff Butler, Lexington, SC (US)

(73) Assignee: Allied Air Enterprises Inc., West Columbia, SC (US)

( * ) Notice: Subject to any disclaimer, the term of this patent is extended or adjusted under 35 U.S.C. 154(b) by 300 days.

(21) Appl. No.: 16/389,017

(22) Filed: Apr. 19, 2019

(65) Prior Publication Data

US 2020/0333043 A1 Oct. 22, 2020

(51) Int. Cl.

| | |
|---|---|
| ***F24H 3/08*** | (2006.01) |
| ***F24H 3/06*** | (2006.01) |
| ***F24D 19/10*** | (2006.01) |
| *F24H 3/10* | (2006.01) |
| *F24D 5/02* | (2006.01) |
| *F24H 9/20* | (2006.01) |

(52) U.S. Cl.

CPC ..... *F24H 3/087* (2013.01); *F24D 19/1084* (2013.01); *F23D 2209/00* (2013.01); *F23D 2209/10* (2013.01); *F23D 2209/20* (2013.01); *F23D 2209/30* (2013.01); *F24D 5/02* (2013.01); *F24H 9/2085* (2013.01)

(58) Field of Classification Search

CPC ..... F24H 3/087; F24H 3/006; F24H 3/065; F24H 3/105; F24H 9/2085; F24H 9/2042; F24D 5/02; F24D 19/1084; F24D 19/10; F23D 2209/00; F23D 2209/30

USPC ..... 126/116 R, 99 D, 116 A

IPC ..... F24H 3/06,3/08, 3/10; F24D 5/02

See application file for complete search history.

(56) References Cited

U.S. PATENT DOCUMENTS

| | | | | |
|---|---|---|---|---|
| 3,737,131 A * | 6/1973 | Larson | A47F 5/0823 | 248/220.41 |
| 4,773,848 A * | 9/1988 | Jalbert | F23D 14/72 | 126/116 A |
| 4,951,651 A * | 8/1990 | Shellenberger | F23N 5/245 | 126/116 R |
| 4,982,721 A * | 1/1991 | Lynch | F23N 1/022 | 126/116 A |
| 5,197,664 A * | 3/1993 | Lynch | F23N 5/242 | 236/11 |
| 5,293,860 A * | 3/1994 | Tomlinson | F23L 17/00 | 126/110 R |
| 5,535,501 A * | 7/1996 | Hoeffken | F23M 11/00 | 29/513 |
| 5,553,553 A * | 9/1996 | Hoeffken | F23M 11/00 | 110/190 |

(Continued)

*Primary Examiner* — Steven B McAllister
*Assistant Examiner* — Daniel E. Namay
(74) *Attorney, Agent, or Firm* — Shackelford, Bowen, McKinley & Norton, LLP

(57) ABSTRACT

A furnace includes a gas burner exposed to a heat-exchange tube. An inducer is fluidly coupled to the heat-exchange tube and configured to induce draft air through the heat-exchange tube. A regulator is fluidly coupled to the gas burner. A rollout shield is disposed adjacent to the gas burner. A rollout switch is disposed in the rollout shield. The rollout switch is electrically coupled to the regulator. At least one vent is formed through the rollout shield adjacent to the rollout switch. The vent provides a path for a rollout flame to the rollout switch. The at least one vent is disposed on at least two sides of the rollout switch.

19 Claims, 8 Drawing Sheets

(56) References Cited

U.S. PATENT DOCUMENTS

| | | | | |
|---|---|---|---|---|
| RE37,128 | E * | 4/2001 | Tomlinson | F23L 17/00 126/110 R |
| 9,317,046 | B2 * | 4/2016 | Gum | F24H 9/2035 |
| 2007/0272228 | A1 * | 11/2007 | Slaby | F24H 3/087 126/104 A |
| 2008/0127963 | A1 | 6/2008 | Thompson | |
| 2010/0001087 | A1 | 1/2010 | Gum | |
| 2014/0030662 | A1 | 1/2014 | Noman | |
| 2016/0195285 | A1 * | 7/2016 | Gum | F24H 1/46 237/2 A |
| 2017/0176048 | A1 | 6/2017 | Schneider et al. | |
| 2017/0176049 | A1 | 6/2017 | Perez et al. | |

* cited by examiner

METHOD AND SYSTEM FOR VENTED ROLLOUT SWITCH

TECHNICAL FIELD

The present disclosure relates generally to furnaces and more particularly, but not by way of limitation to gas furnaces having vents located adjacent to a rollout switch.

BACKGROUND

This section provides background information to facilitate a better understanding of the various aspects of the disclosure. It should be understood that the statements in this section of this document are to be read in this light, and not as admissions of prior art.

Gas furnaces operate by generating a gas flame, which is drawn into a heat-exchange tube by an inducer. During operation of the gas furnace, the heat exchange tube may become cracked or occluded with debris thereby preventing the inducer from drawing the gas flame into the heat-exchange tube. Such conditions result in the gas flame extending rearwardly outside of the heat-exchange tube (commonly referred to as a "rollout" or a "lazy flame").

SUMMARY

Various aspects of the disclosure relate to a furnace. The furnace includes a gas burner exposed to a heat-exchange tube. An inducer is fluidly coupled to the heat-exchange tube and configured to induce draft air through the heat-exchange tube. A regulator is fluidly coupled to the gas burner. A rollout shield is disposed adjacent to the gas burner. A rollout switch is disposed in the rollout shield. The rollout switch is electrically coupled to the regulator. At least one vent is formed through the rollout shield adjacent to the rollout switch. The vent provides a path for a rollout flame to the rollout switch. The at least one vent is disposed on at least two sides of the rollout switch.

Various aspects of the disclosure relate to a rollout shield for use with a gas furnace. The rollout shield includes a switch aperture formed through the rollout shield and sized to receive a rollout switch. A first plurality of vents are formed on a first side of the switch aperture. A second plurality of vents are formed on a second side of the switch aperture. The first plurality of vents and the second plurality of vents provide a path for a rollout flame to the rollout switch.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

The disclosure is best understood from the following detailed description when read with the accompanying figures. It is emphasized that, in accordance with standard practice in the industry, various features are not drawn to scale. In fact, the dimensions of various features may be arbitrarily increased or reduced for clarity of discussion.

DETAILED DESCRIPTION

Various embodiments will now be described more fully with reference to the accompanying drawings. The disclosure may, however, be embodied in many different forms and should not be construed as limited to the embodiments set forth herein.

Gas furnaces operate by generating a gas flame, which is drawn into a heat-exchange tube by an inducer. During operation of the gas furnace, the heat exchange tube may become cracked or occluded with debris thereby preventing the inducer from drawing the gas flame into the heat-exchange tube. Such conditions result in the gas flame extending rearwardly outside of the heat-exchange tube (commonly referred to as a "rollout" or a "lazy flame"). If rollout conditions are permitted to persist, severe damage to the gas furnace can result. In an effort to prevent furnace damage resulting from rollout conditions, a temperature-sensitive switch (commonly referred to as a "rollout switch") is installed in a furnace housing near the heat-exchange tubes. However, space constraints can make proper positioning of the rollout switch difficult. Additionally, a rollout flame will move in a direction of airflow and, thus, may not be drawn to the rollout switch. Also, during normal operation of the gas furnace, temperature within the furnace housing may increase beyond the threshold temperature of the rollout switch causing the rollout switch to trip. Such an event is commonly referred to as a "nuisance trip" and interrupts proper operation of the gas furnace.

Figure 1:
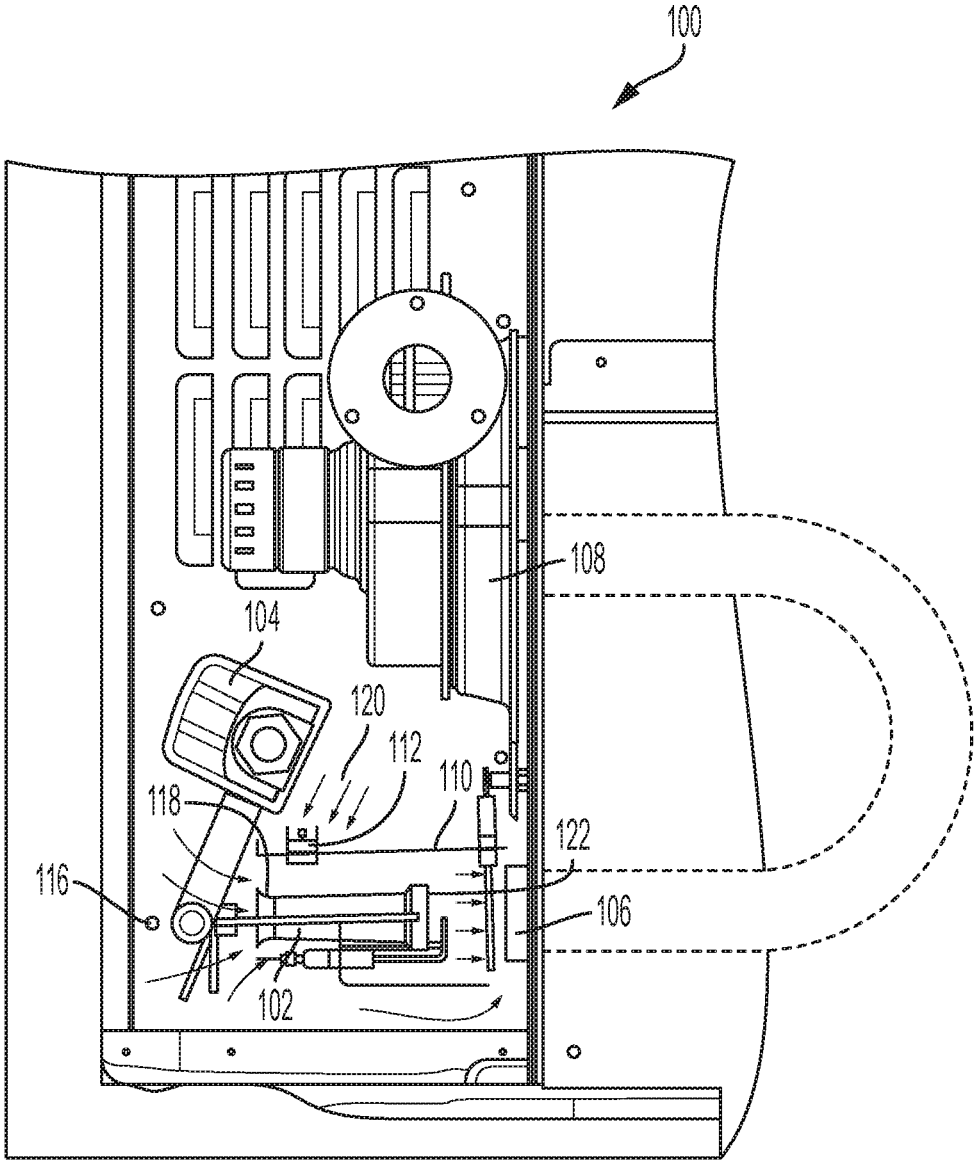
FIG. 1 is a schematic diagram of a gas furnace according to aspects of the disclosure.

FIG. 1 is a schematic diagram of a gas furnace 100. The gas furnace 100 includes a burner 102. In various embodiments, the burner 102 utilizes a gas fuel such as, for example, propane or natural gas, to create a gas flame. In various embodiments, the gas fuel is supplied to the burner 102 by a regulator 104. The gas flame is drawn from the burner 102 into a heat exchange tube 106 by an inducer 108. In various embodiments, the inducer 108 is, for example a squirrel-cage fan that is capable of inducing a draft airflow through the heat-exchange tube 106; however, in other embodiments, any type of fan could be utilized. In various embodiments, the burner 102 consumes primary combustion air 116, which enters the burner 102 from a rear aspect 118 of the burner 102 and secondary combustion air 120 which enters the burner 102 from a front aspect 122 of the burner 102.

Still referring to FIG. 1, a rollout shield 110 is disposed above the burner 102 near the heat-exchange tube 106. In various embodiments, the rollout shield 110 is positioned between the burner 102 and the inducer 108 in an effort to protect internal components of the gas furnace 100 during rollout conditions. A rollout switch 112 is disposed in the rollout shield 110 so as to be exposed to a rollout flame during rollout conditions. In various embodiments, the rollout switch 112 is a temperature sensitive switch and is electrically coupled to the regulator 104. In various embodiments, the rollout switch 112 includes a bi-metal disk that controls the on/off operation of the rollout switch 112. When the temperature around the rollout switch 112 exceeds a threshold temperature, the bi-metal disk bends to the open position thereby interrupting electrical current to the regulator 104. In various embodiments, the rollout switch 112 includes a manual reset button that, when pressed, bends the bi-metal disk into the closed position. Thus, during operation, when a temperature of the rollout switch 112 exceeds a threshold temperature, indicating, for example, rollout conditions resulting from a blocked or cracked heat-exchange tube, the rollout switch 112 opens, thereby interrupting electrical current to the regulator 104. In various embodiments, the rollout switch 112 has a threshold in the range of approximately 200° F. to approximate 350° F. Interruption of the electrical current to the regulator 104 causes the regulator 104 to cut off the supply of gas fuel to the burner 102, thereby shutting down the gas furnace 100.

Figure 2:
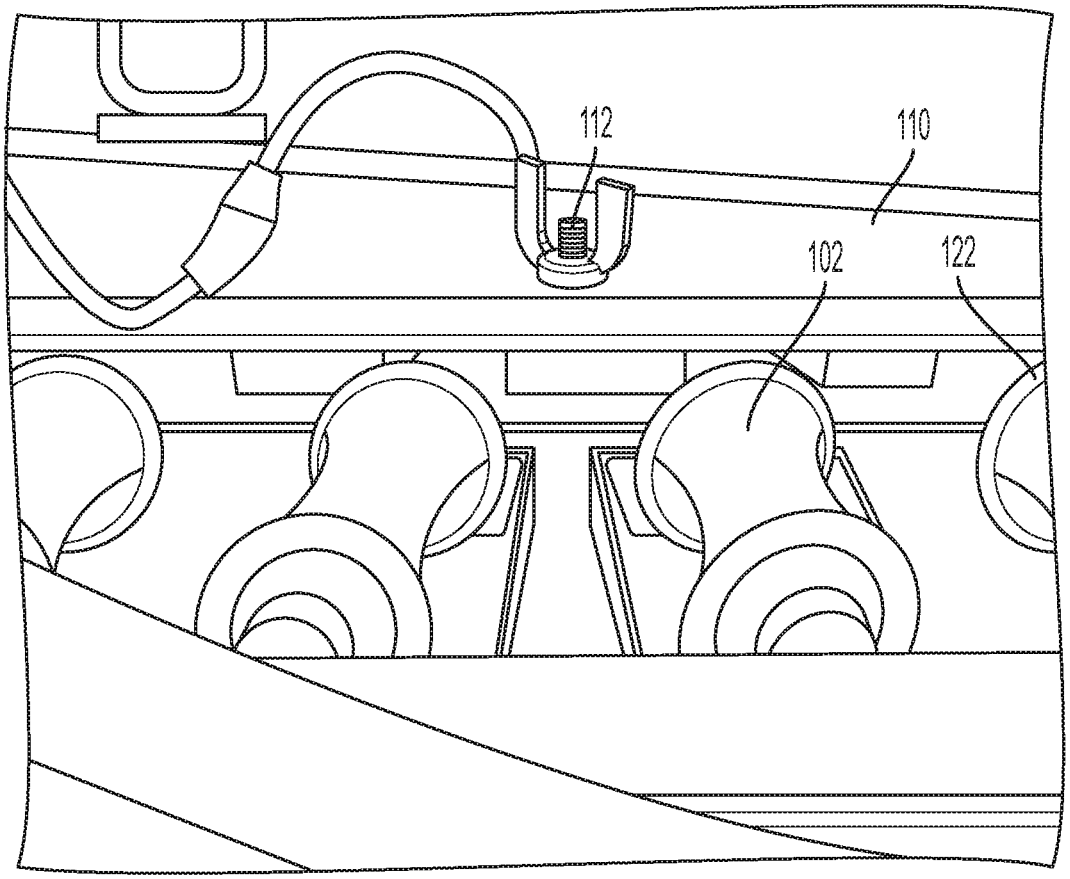
FIG. 2 is a perspective view of a burner and a rollout shield according aspects of the disclosure.

FIG. 2 is a perspective view of the burner 102 and the rollout shield 110. The rollout shield 110 extends above the burner 102. The rollout switch 112 is positioned in the rollout shield 110. In various embodiments, the rollout switch 112 is positioned rearwardly of the front aspect 122 of the burner 102 so as to be positioned to detect rollout conditions.

Figure 3:
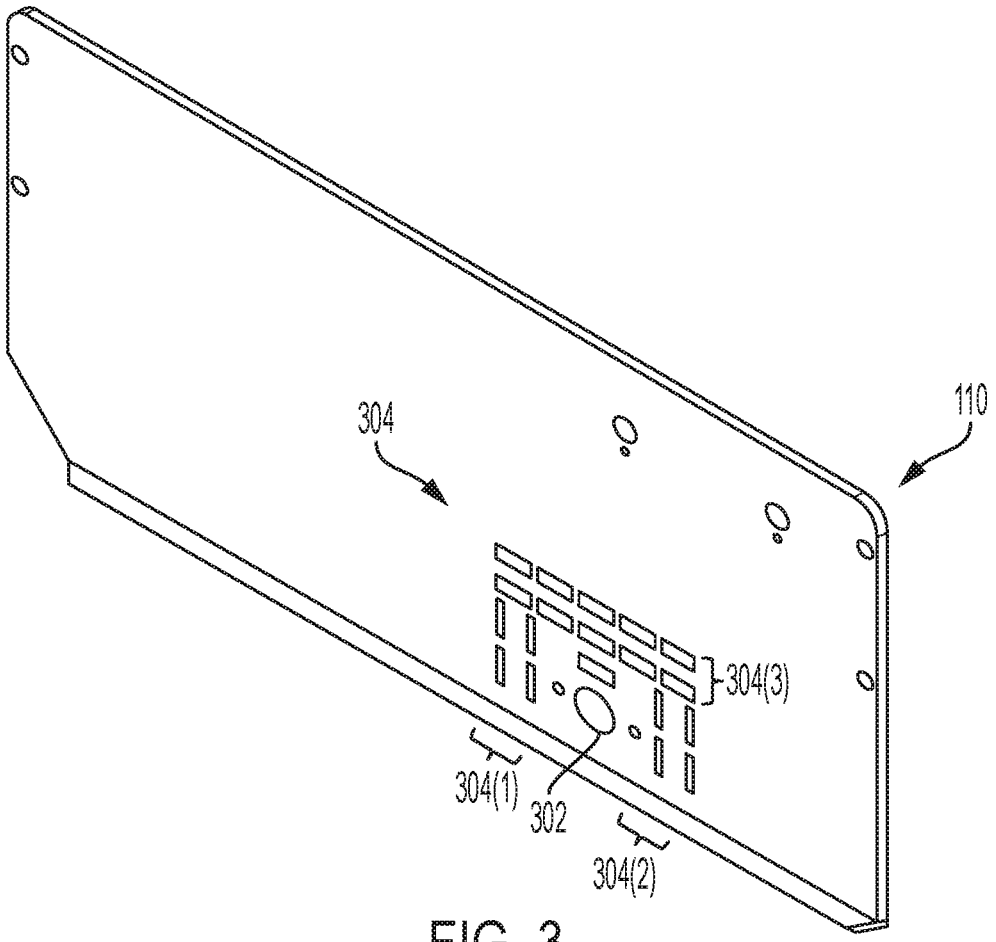
FIG. 3 is a perspective view of a rollout shield according to aspects of the disclosure.
Figure 4:
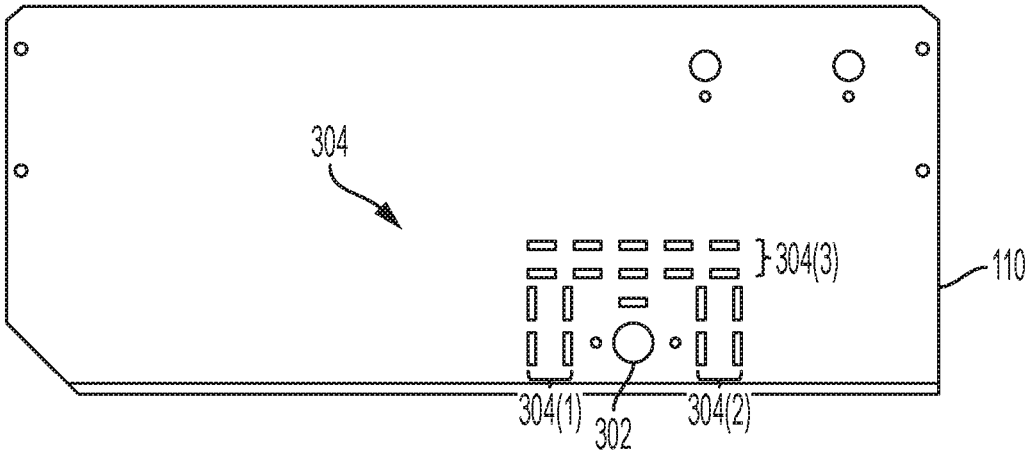
FIG. 4 is a front view of a rollout shield according to aspects of the disclosure.

FIG. 3 is a perspective view of the rollout shield 110. FIG. 4 is a front view of a rollout shield 110. Referring to FIGS. 3-4, collectively, the rollout shield 110 includes a switch aperture 302 that is sized to receive the rollout switch 112 (shown in FIGS. 1-2). Vents 304 are formed through the rollout shield 110 adjacent to the switch aperture 302. In various embodiments, the vents 304 may include a first plurality of vents 304(1), a second plurality of vents 304(2), and a third plurality of vents 304(3) arranged on first, second, and third sides of the switch aperture 302, respectively. In various embodiments, the first plurality of vents 304(1), the second plurality of vents 304(2), and the third plurality of vents 304(3) may include two parallel rows of vents; however, in other embodiments, the first plurality of vents 304(1), the second plurality of vents 304(2), and the third plurality of vents 304(3) may be arranged in any pattern. In various embodiments, the first plurality of vents 304(1), the second plurality of vents 304(2), and the third plurality of vents 304(3) may be arranged either parallel or perpendicular to each other.

Still referring to FIG. 3, during operation of the gas furnace 100 in normal conditions, the vents 304 provide ventilation to the rollout switch 112 in an effort to keep the rollout switch 112 below the threshold temperature. Such ventilation lowers the possibility of nuisance tripping of the rollout switch 112 due to high combustion temperatures that are present within the gas furnace 100. Additionally, the vents 304 provide a source of secondary combustion air to the combustion flame. During operation of the gas furnace 100 in rollout conditions, the rollout flame will be attracted to a source of combustion air. As such, the rollout flame, which typically has a temperature of over 1000° F., will propagate towards and through the vents 304, which are adjacent to the rollout switch 112. Attraction of the rollout flame through the vents 304 increases the probability that the rollout switch 112 will be tripped during rollout conditions due to the high temperature of the rollout flame. Thus, the rollout switch 112 is tripped by the rollout flame itself and not the temperature of the air surrounding the rollout flame. Thus, the vents 304, allow the rollout switch 112 to have a higher threshold temperature than if the vents 304 were not utilized due to the high temperature of the rollout flame. Such an arrangement also allows the use of a single threshold temperature within the gas furnace 100.

Figure 5:
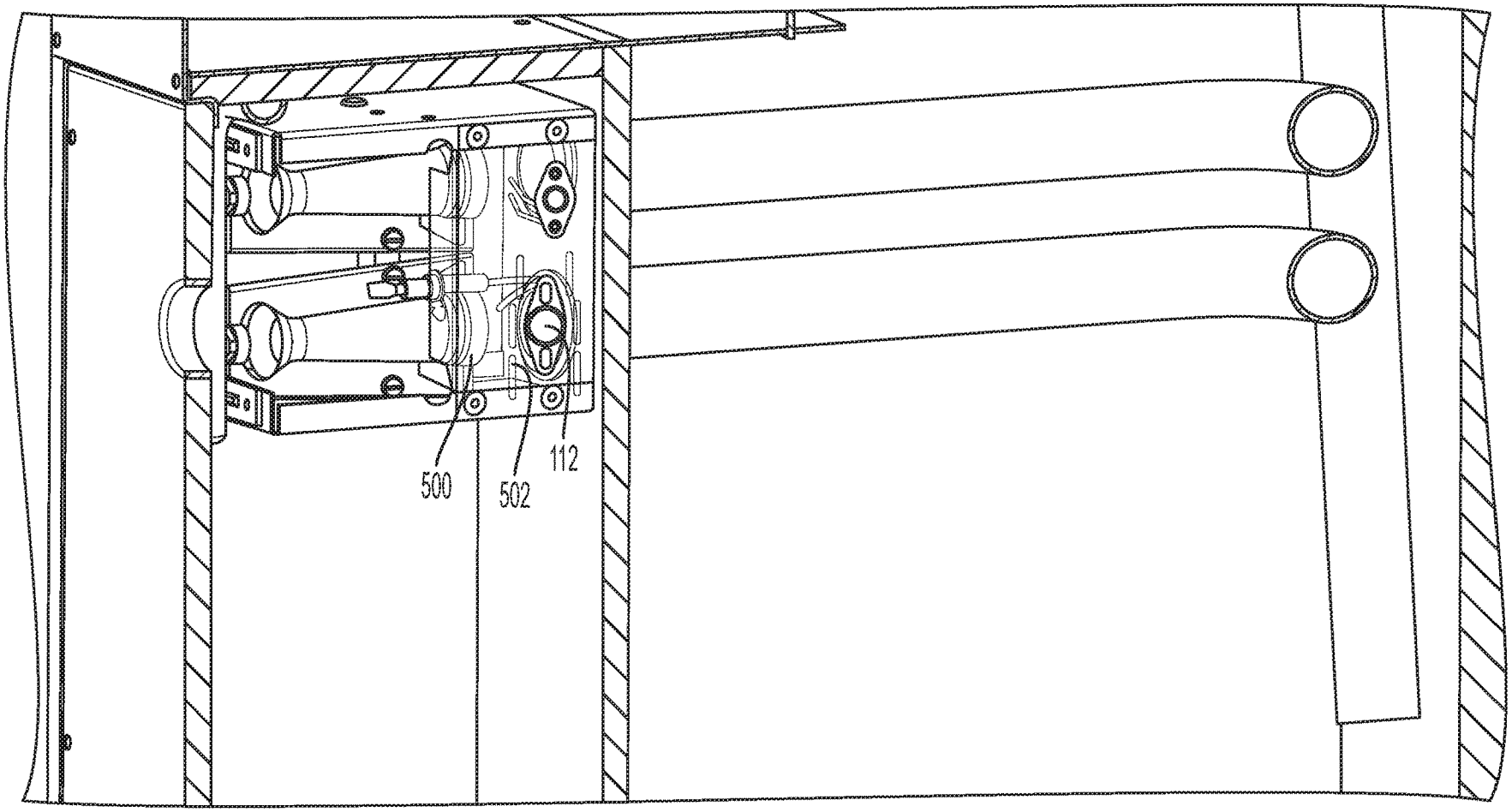
FIG. 5 is a perspective view of an alternative rollout shield according to aspects of the disclosure.

FIG. 5 is a perspective view of an alternative rollout shield 500. The alternative rollout shield 500 includes the rollout switch 112 received therein. Vents 502 are formed through the alternative rollout shield 500 adjacent to the rollout switch 112. During operation of the gas furnace 100 in rollout conditions, the rollout flame will be attracted to a source of combustion air. As such, the rollout flame will propagate towards and through the vents 502, which are adjacent to the rollout switch 112. Attraction of the rollout flame through the vents 502 increases the probability that the rollout switch 112 will be tripped during rollout conditions. Additionally, the vents 502 may be in any configuration or shape, thereby facilitating placement of the rollout switch 112 in space-constrained areas of the gas furnace 100. In various embodiments, for example, the vents 502 could be oval slots, square slots, circular, triangular, or any other appropriate shape. Additionally, the vents 502 may, in various embodiments, include louvers or tabs to direct the rollout flame towards the rollout switch 112.

Figure 6:
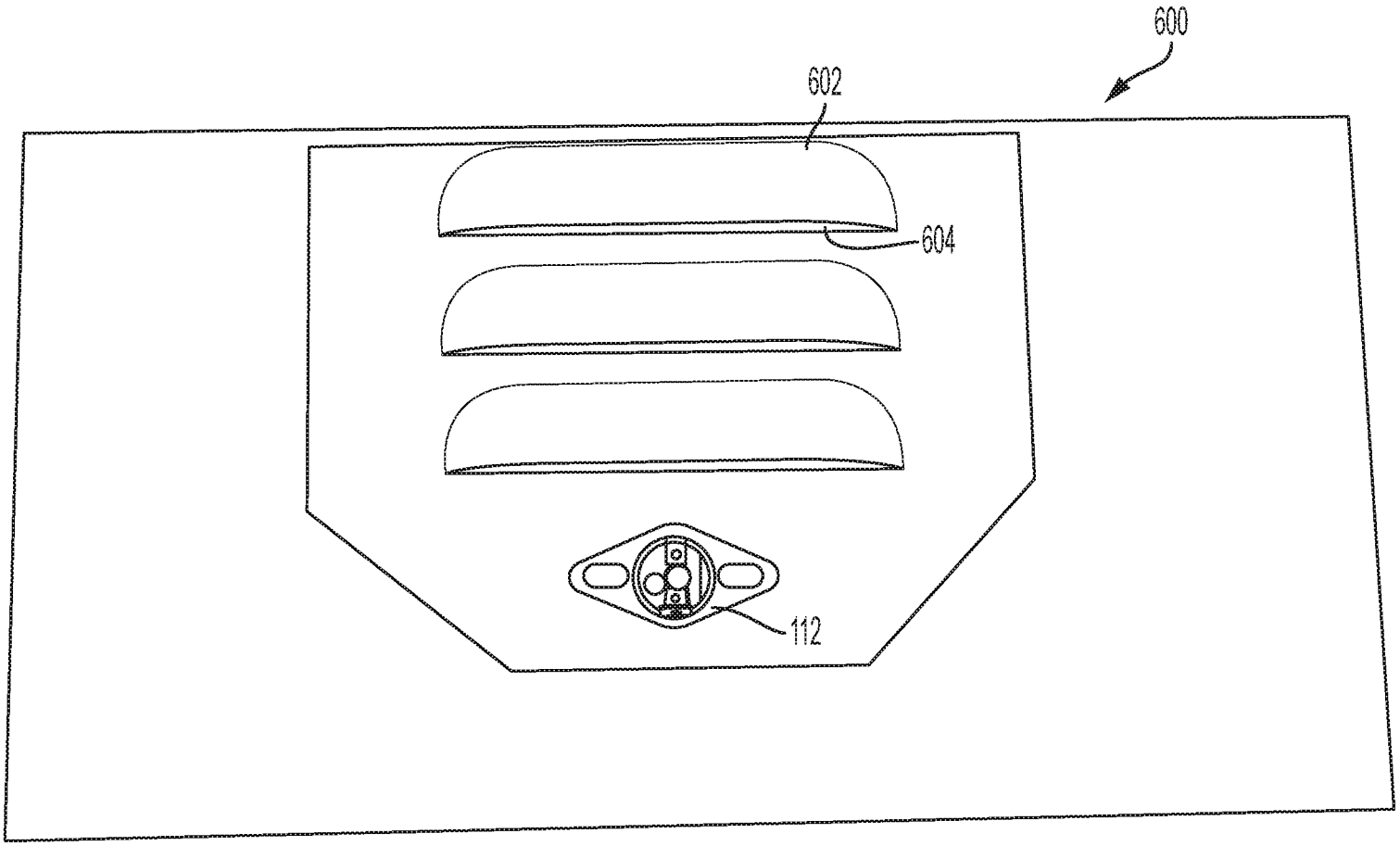
FIG. 6 is a plan view of an alternative rollout shield having louvers.

FIG. 6 is a plan view of an alternative rollout shield 600 having louvers 602. Slots 604 include louvers 602 that direct airflow towards the rollout switch 112. During rollout conditions, the louvers 604 direct a rollout flame over the rollout switch 112 and increase the likelihood that the rollout switch 112 will be tripped. As shown by way of example in FIG. 6, the slots 604 are arranged in three rows on a single side of the rollout switch 112; however, in other embodiments, the slots 602 could be arranged in any pattern and on one or multiple sides of the rollout switch 112.

Figure 7:
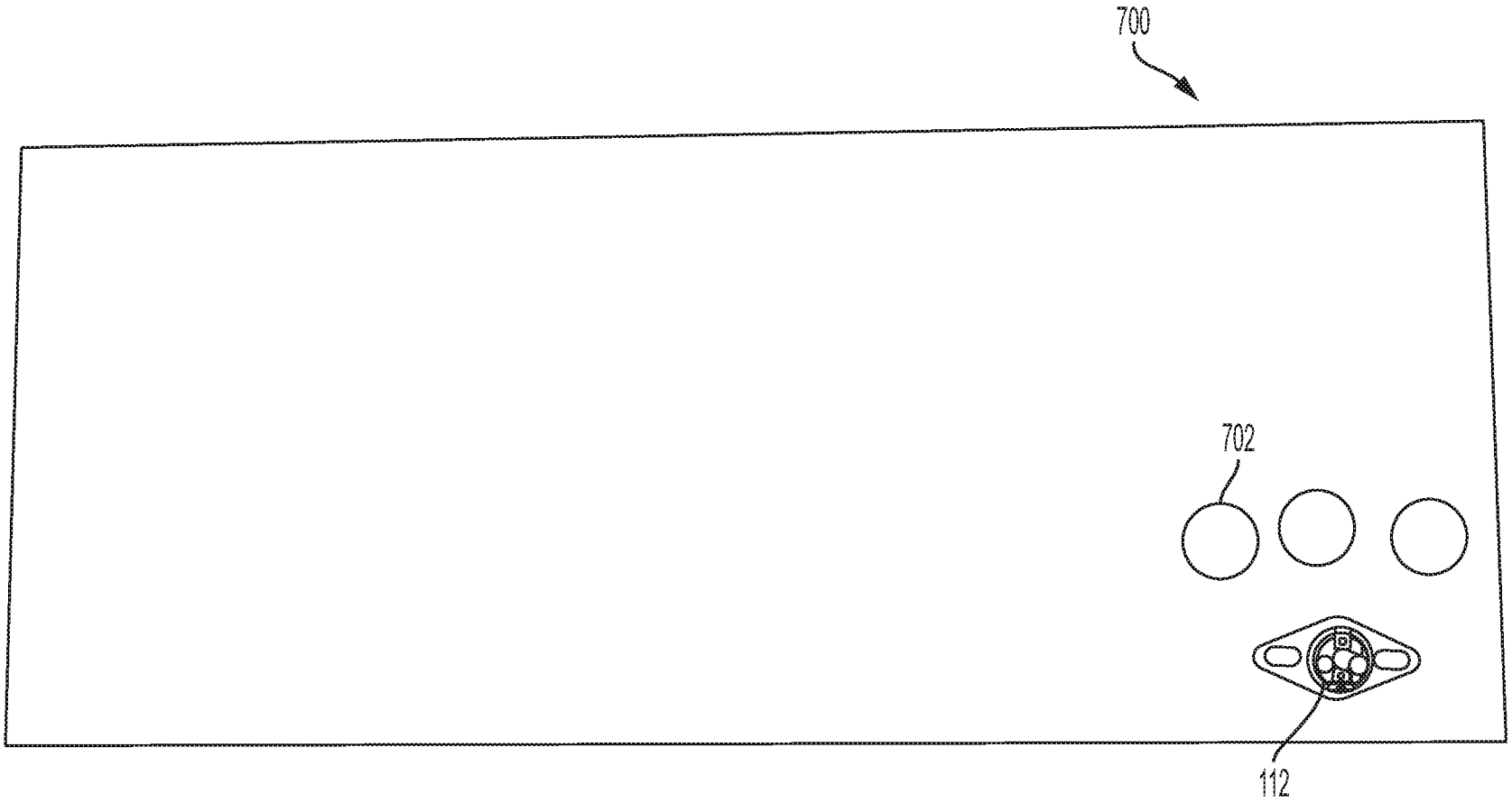
FIG. 7 is a plan view of an alternative rollout shield having round vents.
Figure 8:
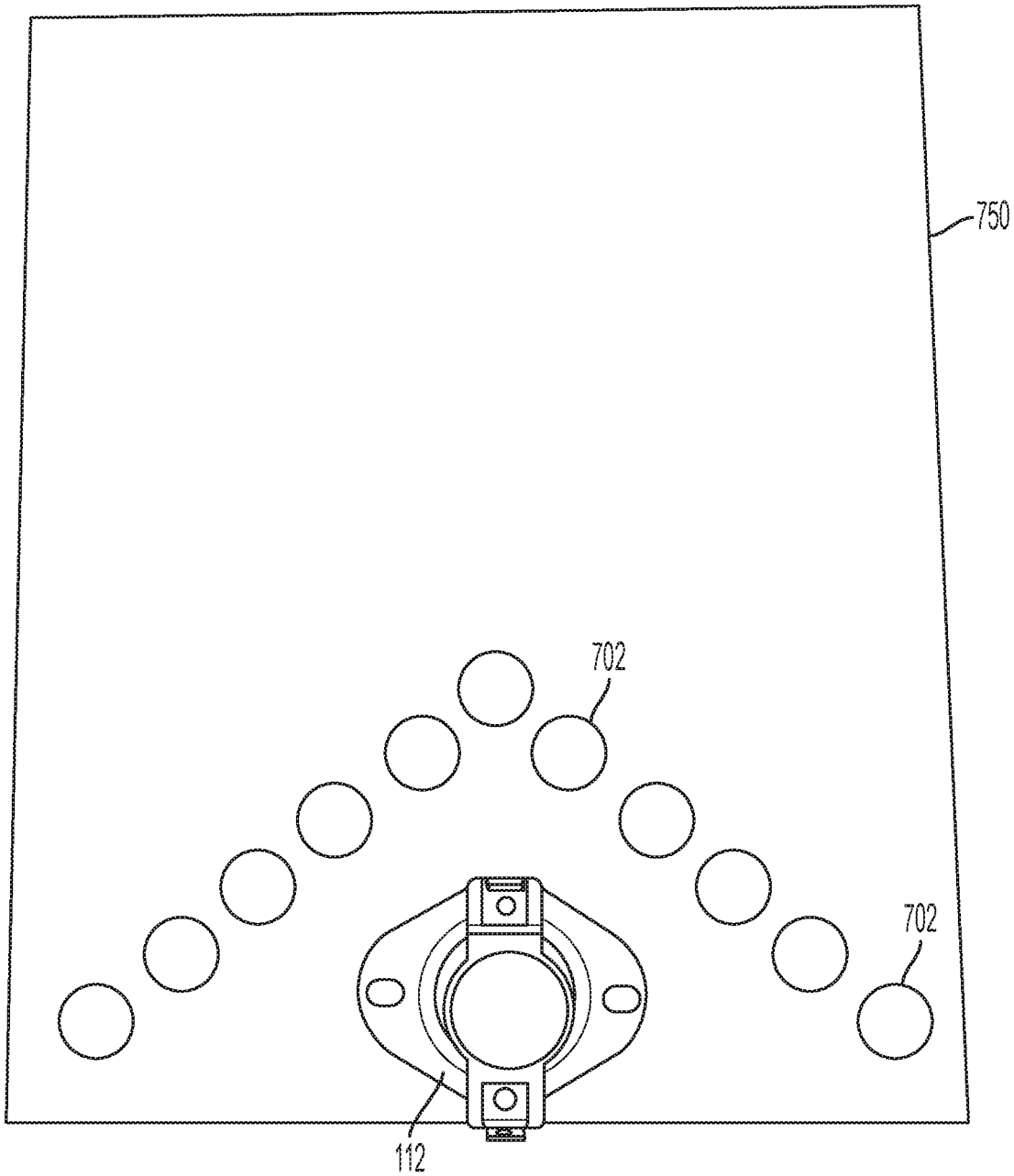
FIG. 8 is a plan view of an alternative rollout shield having vents in a, chevron pattern.

FIG. 7 is a plan view of an alternative rollout shield 700 having round vents 702. As shown by way of example in FIG. 7, the round vents 702 are arranged in a group of three vents on a single side of the rollout switch 112; however, in other embodiments, the round vents 702 could be positioned in any pattern and arranged on one or multiple sides of the rollout switch 112. As an example, FIG. 8 is a plan view of an alternative rollout shield 750 having the round vents 702 in a chevron pattern. During operation, the chevron pattern of the round vents 702 exposes multiple sides of the rollout switch 112 to airflow during operation in normal conditions and, during rollout conditions, exposes multiple sides of the rollout switch. 112 to a rollout flame.

The term "substantially" is defined as largely but necessarily wholly what is specified (and includes what is specified; e.g., substantially 90 degrees includes 90 degrees and substantially parallel includes parallel), as understood by a person of ordinary skill in the art. In any disclosed embodiment, the terms "substantially," "approximately," "generally," and "about" may be substituted with "within 10% of" what is specified.

Conditional language used herein, s among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

While the above detailed description has shown, described, and pointed out novel features as applied to various embodiments, it will be understood that various omissions, substitutions, and changes in the form and details of the devices or algorithms illustrated can be made without departing from the spirit of the disclosure. As will be recognized, the processes described herein can be embodied within a form that does not provide all of the features and benefits set forth herein, as some features can be used or practiced separately from others. The scope of protection is defined by the appended claims rather than by the foregoing description. All changes which come within the meaning and range of equivalency of the claims are to be embraced within their scope.

What is claimed is:

1. A furnace comprising:

a gas burner exposed to a heat-exchange tube;

an inducer fluidly coupled to the heat-exchange tube and configured to induce draft air through the heat-exchange tube;

a regulator fluidly coupled to the gas burner;

a rollout shield disposed above the gas burner and below the inducer;

a rollout switch disposed in the rollout shield, the rollout switch being electrically coupled to the regulator; and at least one vent formed through the rollout shield adjacent to the rollout switch, the vent providing a path for a rollout flame to the rollout switch, the at least one vent being disposed on at least two sides of the rollout switch.

2. The furnace of claim 1, wherein the at least one vent provides a source of secondary combustion air to the gas burner.

3. The furnace of claim 1, wherein the at least one vent comprises at least one of a tab and a louver.

4. The furnace of claim 1, wherein the at least one vent comprises a plurality of vents.

5. The furnace of claim 4, wherein the plurality of vents are arranged on all sides of the rollout switch.

6. The furnace of claim 4, wherein the plurality of vents are arranged on at least two sides of the rollout switch.

7. The furnace of claim 1, wherein the at least one vent facilitates airflow around the rollout switch.

8. The furnace of claim 7, wherein the at least one vent prevents nuisance tripping of the rollout switch.

9. The furnace of claim 1, wherein tripping the rollout switch interrupts electrical current to the regulator.

10. A rollout shield for use with a gas furnace, the rollout shield comprising:

a switch aperture formed through the rollout shield and sized to receive a rollout switch;

a first plurality of vents formed on a first side of the switch aperture;

a second plurality of vents formed on a second side of the switch aperture;

wherein the first plurality of vents and the second plurality of vents provide a path for a rollout flame to the rollout switch; and wherein the rollout shield is disposed above a gas burner and below an inducer of the gas furnace.

11. The rollout shield of claim 10, comprising a third plurality of vents formed on a third side of the switch aperture.

12. The rollout shield of claim 11, wherein the third plurality of vents is arranged generally perpendicular to the first plurality of vents and the second plurality of vents.

13. The rollout shield of claim 11, wherein the third plurality of vents comprises at least two parallel rows of vents.

14. The rollout shield of claim 10, wherein at least one of the first plurality of vents and the second plurality of vents comprises at least one of a tab and a louver.

15. The rollout shield of claim 10, wherein the first plurality of vents and the second plurality of vents facilitate airflow around the rollout switch.

16. The rollout shield of claim 15, wherein the first plurality of vents and the second plurality of vents prevent nuisance tripping of the rollout switch.

17. The rollout shield of claim 10, wherein the first plurality of vents is arranged generally parallel to the second plurality of vents.

18. The rollout shield of claim 10, wherein the first plurality of vents is arranged generally perpendicular to the second plurality of vents.

19. The rollout switch of claim 10, wherein at least one of the first plurality of vents and the second plurality comprise at least two parallel rows of vents.

* * * * *